United States Patent [19]

Beyl

[11] 4,182,524

[45] Jan. 8, 1980

[54] SAFETY SKI BINDING

[75] Inventor: Jean A. J. Beyl, Nevers, France

[73] Assignee: Look S.A., Nevers, France

[21] Appl. No.: 933,634

[22] Filed: Aug. 14, 1978

[30] Foreign Application Priority Data

| | | | |
|---|---|---|---|
| Aug. 26, 1977 | [FR] | France | 77 26029 |
| Mar. 10, 1978 | [FR] | France | 78 06942 |
| Jun. 16, 1978 | [FR] | France | 78 18056 |

[51] Int. Cl.[2] ..... A63C 9/081

[52] U.S. Cl. ..... 280/618; 280/624

[58] Field of Search ..... 280/624, 618, 616, 620, 280/613, 627, 631, 611

[56] References Cited

U.S. PATENT DOCUMENTS

| | | | |
|---|---|---|---|
| 2,676,813 | 4/1954 | Beyl | 280/618 |
| 3,865,388 | 2/1975 | Haldemann | 280/613 |
| 3,887,205 | 6/1975 | Edmund | 280/624 |
| 3,931,980 | 1/1976 | Marker | 280/613 |

*Primary Examiner*—David M. Mitchell

*Attorney, Agent, or Firm*—Bierman & Bierman

[57] ABSTRACT

This safety ski binding for protecting the skier's leg in case of abnormal lateral torsion and forward and backward fall comprises essentially a hollow case pivoted to the ski and enclosing spring controlling the pivotal movements of the case as well as hooks carried by this case and cooperating with studs projecting laterally from the ski boot. The protection is ensured in case of combined torsion and toe-lift and heel-lift movements. Quick-release and quick-fitting are also provided, together with adjustment of the hardness of the release mechanism.

22 Claims, 19 Drawing Figures

SAFETY SKI BINDING

BACKGROUND OF THE INVENTION

The present invention relates to a safety ski binding comprising a plate or other similar member adapted to act as a support for the ski boot, which is mounted permanently on the ski and adapted to revolve about an axis perpendicular to the top surface of the ski.

The main advantage of this type of binding in comparison with the most popular conventional ski bindings comprising a toe abutment device or mechanism and a heel hold-down device or mechanism is that no sliding frictional contact takes place between the ski boot and the ski when the former rotates in relation to the latter. In fact, when a torsion stress is applied to the skier's leg the plate moves bodily with the boot. Moreover, it is easier to mount a binding of this type on a ski than a toe-end abutment device and heel hold-down device assembly, since only the plate pivot pin has to be secured to the ski.

The movable plate thus contemplated in ski bindings of this type comprises boot retaining means so arranged that the boot is released in case of forward or backward fall. On the other hand, resilient means are provided for constantly urging the movable plate to its normal position on the ski, these resilient means being adapted to permit the rotation of the plate when a torsion stress is exerted on the skier's leg. With this arrangement, a double safety is obtained: on the one hand in case of torsion, and on the other hand in case of forward or backward fall.

Certain known ski bindings of this general character are so designed that the rotation of the plate as a consequence of a torsion movement of the skier's leg is also attended by the movement of the boot retaining means towards their position corresponding to the release of the boot. This is observed notably in the case of the safety ski binding described in applicant's U.S. Pat. No. 3,647,235. In fact, in this patent, a single resilient member holds the rotary plate in its normal, operative position while controlling a jaw gripping the toe end of the boot, the arrangement being such that this jaw can rotate freely to release the boot when the plate has accomplished a predetermined angular movement.

The applicant's U.S. Pat. No. 3,966,218 of June 29, 1976, discloses another safety ski binding of the same general type, which comprises a toe end jaw adapted to slide on the rotary plate. In this case the arrangement is such that when the rotary plate has been moved angularly through a predetermined angle, the jaw supporting slide is unlocked so that the jaw will release the boot instantaneously.

However, in these two safety bindings there is no interaction between the boot retaining means normally counteracting the lifting thereof in case of forward or backward fall, on the other hand, and the retaining means normally counteracting a rotation due to torsion stress, on the other hand. In fact, the rotational movement of the plate has no effect on the heel hold-down means.

Now, this interaction would obviously be extremely desirable from the point of view of safety. In fact, in case of a complex fall, i.e. a fall combining a torsion stress and a traction effort, the tibia bone is considerably more vulnerable than in case of a simple fall. Therefore, when the skier is in a position of want of balance either forwards or backwards, a lateral stress weaker than that required when he is in a normal position is sufficient for breaking his tibia.

However, an interaction of this type is well known in conventional safety ski bindings, notably in the case of heel hold-down devices wherein the jaw can pivot both about a vertical axis to permit the lateral release of the boot and about a horizontal transverse axis to permit the vertical release of the boot. Heel hold-down devices of this type are known wherein the means for locking the jaw in both lateral and vertical directions are operatively interconnected so that unlocking one means entails a reduction in the locking effort exerted by the other, and vice versa.

It is also known through the German patent appln. DT-OS No. 2,504,281 to construct a binding in such a manner that an interaction occurs between a rotatable boot-supporting plate and a member provided on said plate for retaining the boot against lifting movements. For instance, in the form of embodiment illustrated in FIG. 3 of this last-mentioned patent, the heel hold-down member is connected to the rotary plate in such a manner that rotation of the latter is attended by the pivotal movement of the retaining member towards its release position.

Under these conditions, the release of the ski boot by lifting same is facilitated when the plate has already been caused to rotate as a consequence of a torsion stress exerted on the skier's leg.

However, one may question the real efficiency of this retaining member, namely a conventional heel hold-down device, for ensuring a stable centering of the plate as well as a proper elastic resistance of this plate during its rotation. In fact, the spring incorporated in the heel hold-down device and constituting the means for applying a return torque to the plate in order to center the latter, is disposed substantially vertically and therefore parallel to the axis of said torque. Moreover, the necessary return torque is transmitted from the spring to the plate by a connecting member such as a cable passing in a guide member rigid with the ski. This transmission member is therefore uncovered and therefore liable to become embedded in snow or ice, a fact most likely to interfere detrimentally with its operation or even lock it completely, thus jeopardizing the skier's safety.

In another French patent appln No. 7,416,349 (published under No. 2,228,510) there is disclosed a ski binding comprising two resiliently interconnected plates; one plate is secured to the ski and the other plate is connected to the one plate and movable relatively thereto.

The upper plate can perform oscillations of reduced amplitude about an axis perpendicular to the ski surface to generate a signal controlling the opening of the toe end and/or heel end jaws.

Therefore, the upper plate cannot move with the boot during its rotation, so that substantial friction occurs between the boot and the plate. Moreover, if a small-amplitude movement of the upper plate succeeds in actually releasing the lateral hook means, the retaining force on the other hand remains unchanged during a forward fall causing the opening of said lateral hooks, due to the particular nature of the resilient means interconnecting the two plates.

It is the essential object of the present invention to provide a safety ski binding of the general type set forth hereinabove which is at the same time reliable, safe, compact and has a good aesthetic appearance.

The ski binding according to this invention comprises a ski boot supporting member adapted to rotate about an axis perpendicular to the ski surface and provided with at least one boot hooking member mounted on said support for movement between a normal operative position in which said retaining member cooperates with a member rigid with the boot so as to hold the latter against movement on said support, and an inoperative position to which said hooking member is moved when an abnormal load is applied to the skier's leg and said boot is released in relation to said support, resilient means being provided for urging on the one hand said support to its normal position on the ski and on the other hand said hooking member to its operative position.

However, for obtaining the desired result, the boot supporting member has the shape of a flat case formed of either a single compartment or two compartments containing the component elements of a resilient system operative both between said case and a fixed element, on the one hand, and between this case and the hooking member, on the other hand; in addition, a kinematic chain is provided between said case, said hooking member and said resilient system, whereby a movement of rotation of said case tending to move the latter away from its normal position is attended by the release of the force urging said boot hooking member to its operative position, and inversely, when said hooking member is moved towards its inoperative position the force holding the pivoting case against rotation is also released.

It may be noted that only the hooking means is located externally of the case, so that the risks previously mentioned and those due to weather conditions (snow and ice) are reduced very considerably. Due to its particular conception, the ski binding according to the present invention constitutes a reliable, compact and aesthetical device.

In a specific form of embodiment of the present invention, the resilient system comprises one or a plurality of springs acting on the one hand on a cam provided on the fixed pivot pin of the pivoting case, so as to hold and return the latter in and to its normal position, and on the other hand on a cam associated with the boot hooking means, the arrangement being such that the rotation of the case is attended by a decrease in the pressure exerted by said springs on the cam associated with the hooking means, and that conversely the movement of this hooking means towards its inoperative position is attended by a reduction in the pressure exerted by the springs on the pivot cam.

The case is pivoted on a central fixed pivot pin adapted to be fastened to the ski, the movable boot hooking means co-acting with a first piston slidably mounted in the case and urged by resilient means both against the movable boot retaining member in order to resiliently hold the latter in its operative position and against a flat cam provided on the fixed pivot of the case, so as to resiliently hold the case against rotation in its normal position.

In a preferred form of embodiment, the movable hooking means comprises a pair of hooks disposed laterally on the pivoting case on either side of the fixed pivot pin disposed in the central area of the case, and each hook aforesaid includes a ramp adapted to co-act with the corresponding end portion of a spindle passing through a piston and projecting from the case, and the resilient device urging the piston against the hooks and the pivot cam consists of at least one spring reacting against the relevant end of the case, the pivoting hooks being adapted to bear against retaining means rigid with the boot.

According to another form of embodiment, the binding is provided with a single boot hooking means movable between an operative boot-retaining position and an inoperative boot-releasing position, and with a complementary fixed boot hooking means rigid with the boot supporting case.

With this arrangement, only one piston may be provided for urging the movable boot hooking means to its closed position and holding the case against rotation, together with a second piston having only the function of holding the case against rotation. Thus, when the movable boot hooking means is moved, the first piston cannot continue to hold the case against rotation, but on the other hand the second piston, independent of said movable boot hooking means, continues to exert a return torque tending to hold the movable boot hooking means against rotation.

Thus, the binding is simplified considerably.

In other improved forms of embodiment, the present invention also contemplates of further simplifying the above-summarized structures, notably the last-mentioned ones comprising two resilient systems each associated with a piston.

For this purpose, according to another form of embodiment, the case encloses a single resilient system urging the two pistons housed in the case against a pair of cams formed on the opposite faces of a fixed central pivot pin about which the case is adapted to rotate, one of said pistons co-acting with a boot hooking means movable between an operative boot-retaining position and an inoperative release position, and said resilient system and said pair of pistons are so disposed that, in case of front fall of the skier, only the first piston rigid with the movable hooking means moves away from the corresponding cam, the second piston remaining in close engagement with the fixed pivot while maintaining a torque retaining the case in a position of engagement with the ski surface.

With this arrangement, the number of component elements necessary for making the ski binding is reduced considerably while freeing a volume available along about one-half of the case length.

However, many modifications and changes may be brought to the safety ski binding according to the present invention of which several forms of embodiment are shown in the accompanying drawings.

DESCRIPTION OF THE PREFERRED EMBODIMENTS

The first form of embodiment of the ski binding according to this invention, as shown in FIGS. 1 to 9 of the drawings, comprises a flat, elongated case 1 adapted to support the ski boot C. This case 1 is rotatably mounted about a central, fixed pivot pin 2 extending at right angles to the top surface of the ski S. This pivot pin is carried by a plate 3 secured to the ski, for example by means of screws (not shown). The vertical axis XX' of this pivot pin is substantially coincident with the middle point of case 1. On the other hand, as will be explained presently, this axis is also coincident, preferably, with the location contemplated for the median transverse plane of the ski boot C.

At either end the case 1 carries two pairs of hook means 4*a* and 4*b* pivoted to horizontal and transverse pins denoted 5*a* and 5*b*, respectively. The hooks of the two ends are directed in opposite directions, so that the hooking noses of the hooks of each pair be directed towards the hooks of the other pair.

The purpose of these hooks is to co-act with hooking or retaining members projecting from both sides of the sole of boot C, on either side of the median transverse plane of the sole. In fact, the ski binding illustrated in FIGS. 1 to 9, as well as the ski binding shown in FIGS. 10 to 19, have from this specific point of view the same general conception as the ski binding disclosed in the U.S. patent application No. 889,001 filed on Mar. 22, 1978 by the present applicant. Therefore, the lateral retaining members 6*a* and 6*b* of the boot are located at predetermined distances invariable in relation to the median transverse plane thereof, irrespective of the boot size. Of course, the pivoting hooks 4*a* and 4*b* themselves are disposed at predetermined distances from the transverse central plane of the case containing the axis XX', so that the present ski binding can receive different boots of different sizes.

Figure 1:
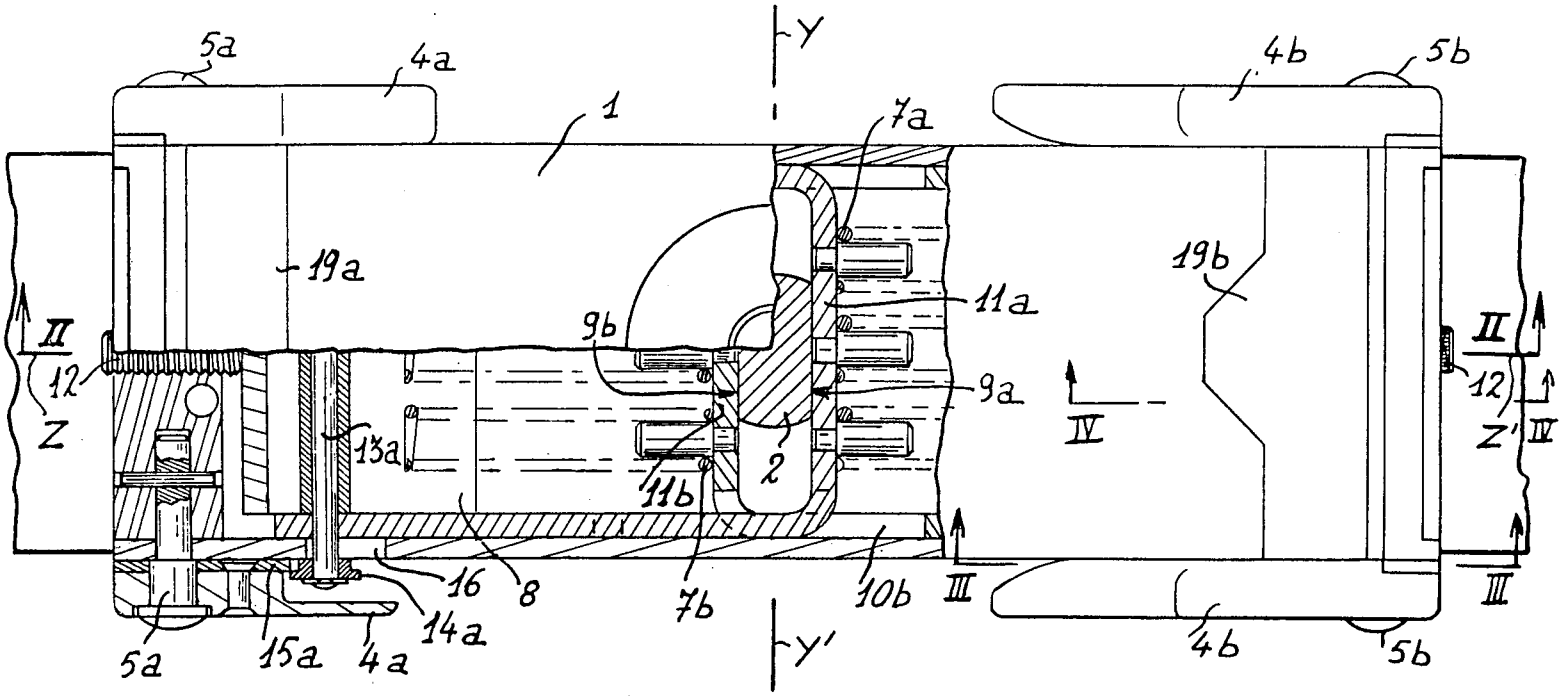
FIG. 1 is a plane view from above with parts broken away, showing a first form of embodiment of the safety ski binding according to the present invention.
Figure 2:
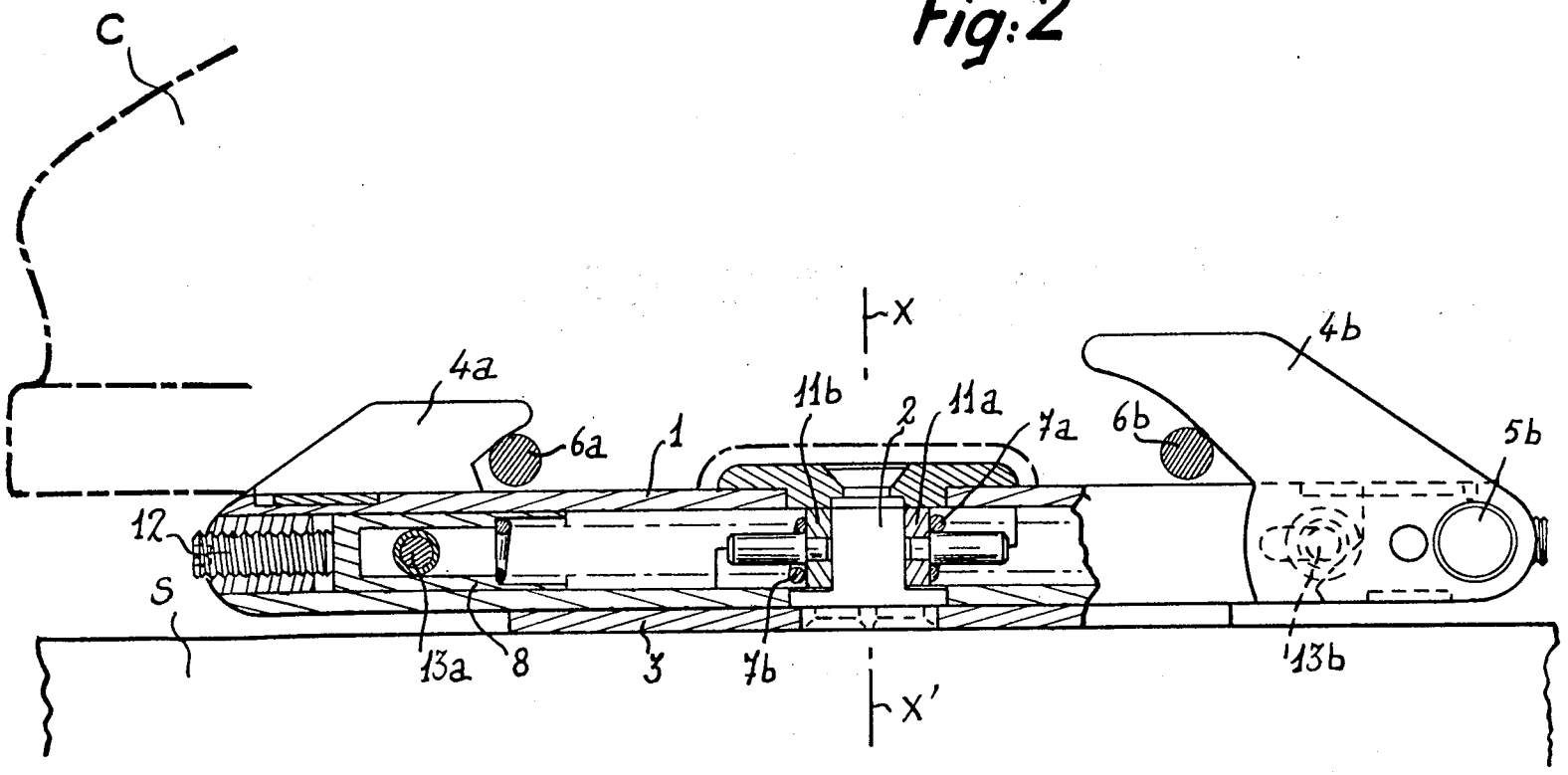
FIG. 2 is a partial elevational side view and partial longitudinal section, the latter being taken along the line II—II of FIG. 1.
Figure 3:
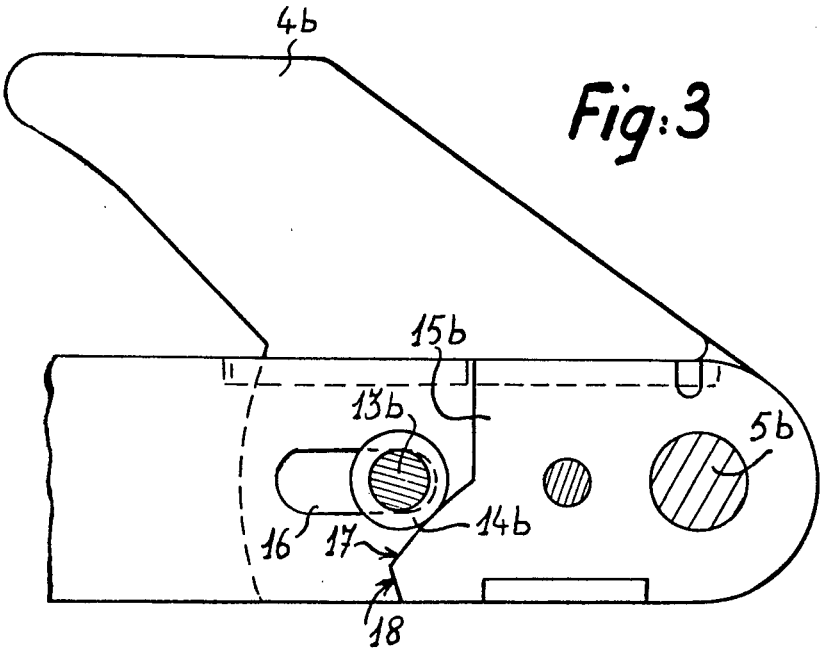
FIGS. 3 and 4 are fragmentary sections taken on a different scale, along lines III—III and IV—IV of FIG. 1, respectively, and showing details.
Figure 4:
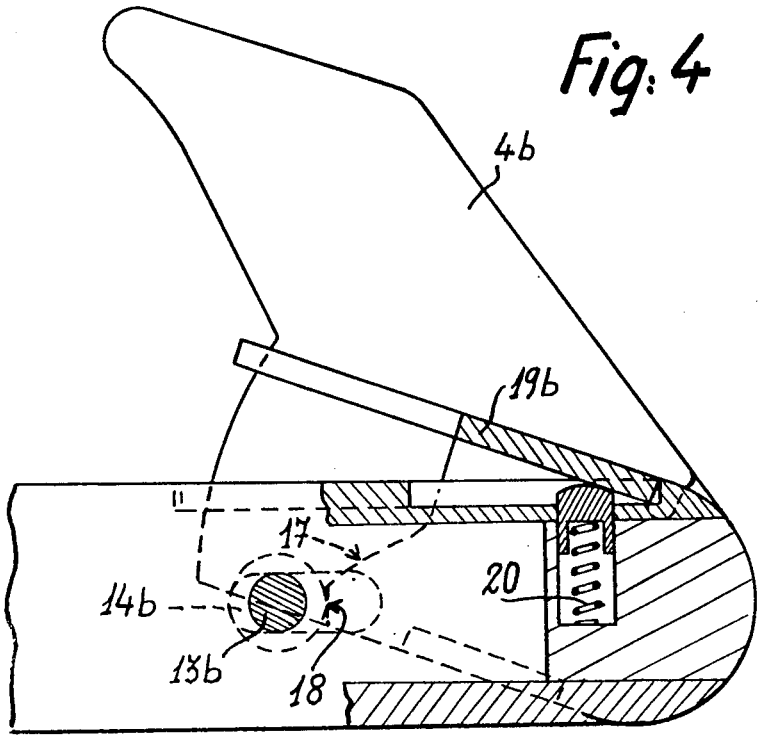

According to an essential feature characterizing the ski binding of the present invention, the mechanism thereof comprises a single resilient system controlling both the rotary case 1, in order to hold it in its normal position on the ski, and the pivoting hooks 4*a* and 4*b* so as to retain them in their operative or hooking position. In fact, these hooks can pivot between an operative hooking position which is their normal position as shown in FIG. 2, and an inoperative position to which they are caused to move when an abnormal load is applied to the skier's leg, in the case of a forward fall as far as the rear hooks 4*b* are concerned, and in the case of a backward fall as far as the front hooks 4*a* are concerned.

The resilient system thus contemplated comprises two series of coil compression springs 7*a* and 7*b* disposed on either side of the central pivot pin 2. These springs react against end sockets 8 for exerting an elastic pressure against a pair of flat vertical cam faces 9*a* and 9*b* of pivot pin 2 through the medium of a pair of sliding straps 10*a* and 10*b* (FIG. 5) acting somewhat like pistons. More particularly, the two series of springs 7*a* and 7*b* constantly urge the transverse median element 11*a* or 11*b* of each strap against the corresponding flat cam face 9*a* or 9*b* formed on the pivot pin. The end sockets 8 are slidably mounted in the corresponding ends of case 1 and the position of each socket is adjustable by means of a screw 12. Therefore, the initial or preset compression of springs 7*a* and 7*b* can be adjusted as required.

It may be noted that the two flat cam faces 9*a* and 9*b* are parallel to the median transverse plane YY'. Consequently, the pressure exerted by the two series of springs 7*a* and 7*b* constantly tend to keep the pivoting case 1 in a position such that its median longitudinal line ZZ' is coincident with the longitudinal axis of the ski.

Figure 5:
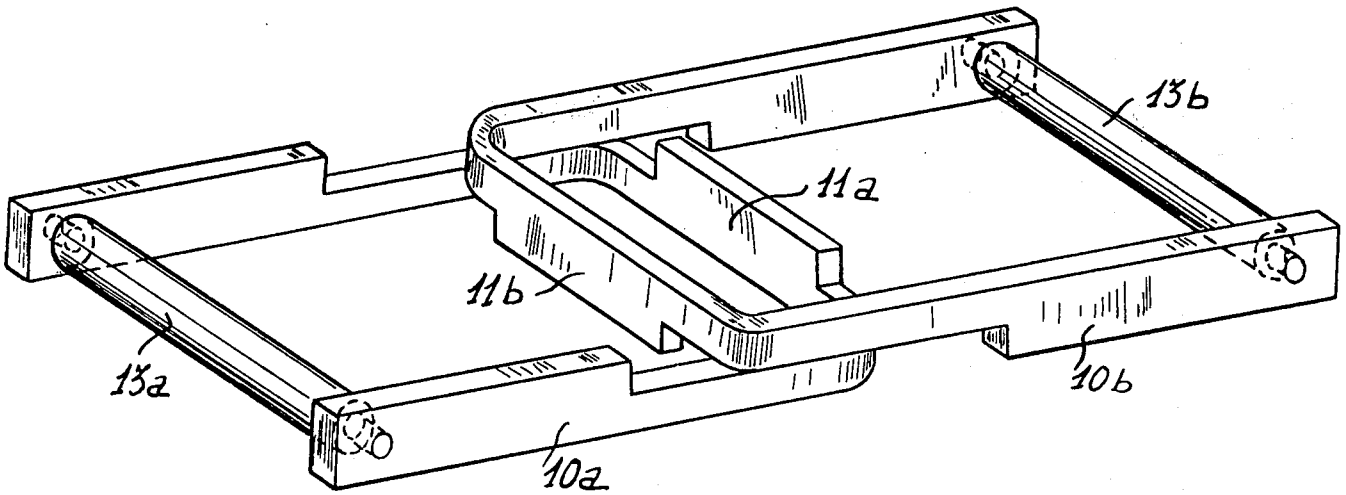
FIG. 5 is a perspective view of the sliding straps through which the springs of the resilient system act upon the cams carried by the pivot of the rotary case.

It may also be noted that the adjacent ends of the pair of sliding straps 10*a* and 10*b* partially overlap each other, as clearly shown in FIG. 5, adequate cutouts being formed in the arms of these straps. At their opposite ends, the lateral arms of the straps each carry a transverse rod 13*a*, 13*b* having rotatably mounted at either end a pair of rollers 14*a*, 14*b*, respectively, controlling cam members 15*a* and 15*b* carried by the corresponding pivoting hooks 4*a* and 4*b*. Thus, the two series of springs 7*a* and 7*b* actually control these hooks while maintaining the rotary case in the proper position, i.e. its normal position.

The rollers 14*a* and 14*b* are located externally of the case 1, the ends of rods 13*a* and 13*b* engaging elongated holes 16 formed in the lateral walls of the case. Each cam 15*a* or 15*b* comprises, registering with the relevant roller 14*a* and 14*b*, an inclined ramp 17 underlying which is a bearing surface 18 separated from said ramp by a projecting angle. The profile of ramp 17 is such that the pressure exerted by the roller 14*a* or 14*b* tends to keep or return the corresponding pivoting hook 4*a* or 4*b* in or to its operative hooking position. The function of bearing surface 18 is to firmly hold the corresponding hook in the raised position, i.e. the inoperative position, after having been moved to the position shown in FIG. 4.

The pair of pivoting hooks 4a and 4b of a same pair are interconnected by a plate 19a or 19b overlying the case 1 and adapted to act as a pedal for re-engaging the corresponding hooks to their operative positions. On the other hand, a thrust spring 20 may advantageously be provided for lifting each pair of hooks when the corresponding rollers do not bear on the roller control cams.

OPERATION

1.—In the normal position:

The ski boot C is firmly held against movement on the top of case 1 by both pairs of hooks 4a and 4b. In fact, as already explained in the foregoing, the pressure exerted through rollers 14a and 14b tends to keep these hooks in their operative positions.

On the other hand, the case 1 is held in its normal position by the pressure exerted on the flat cam faces 9a and 9b of pivot pin 2 by the pistons consisting of the sliding straps 10a and 10b.

Figure 6:
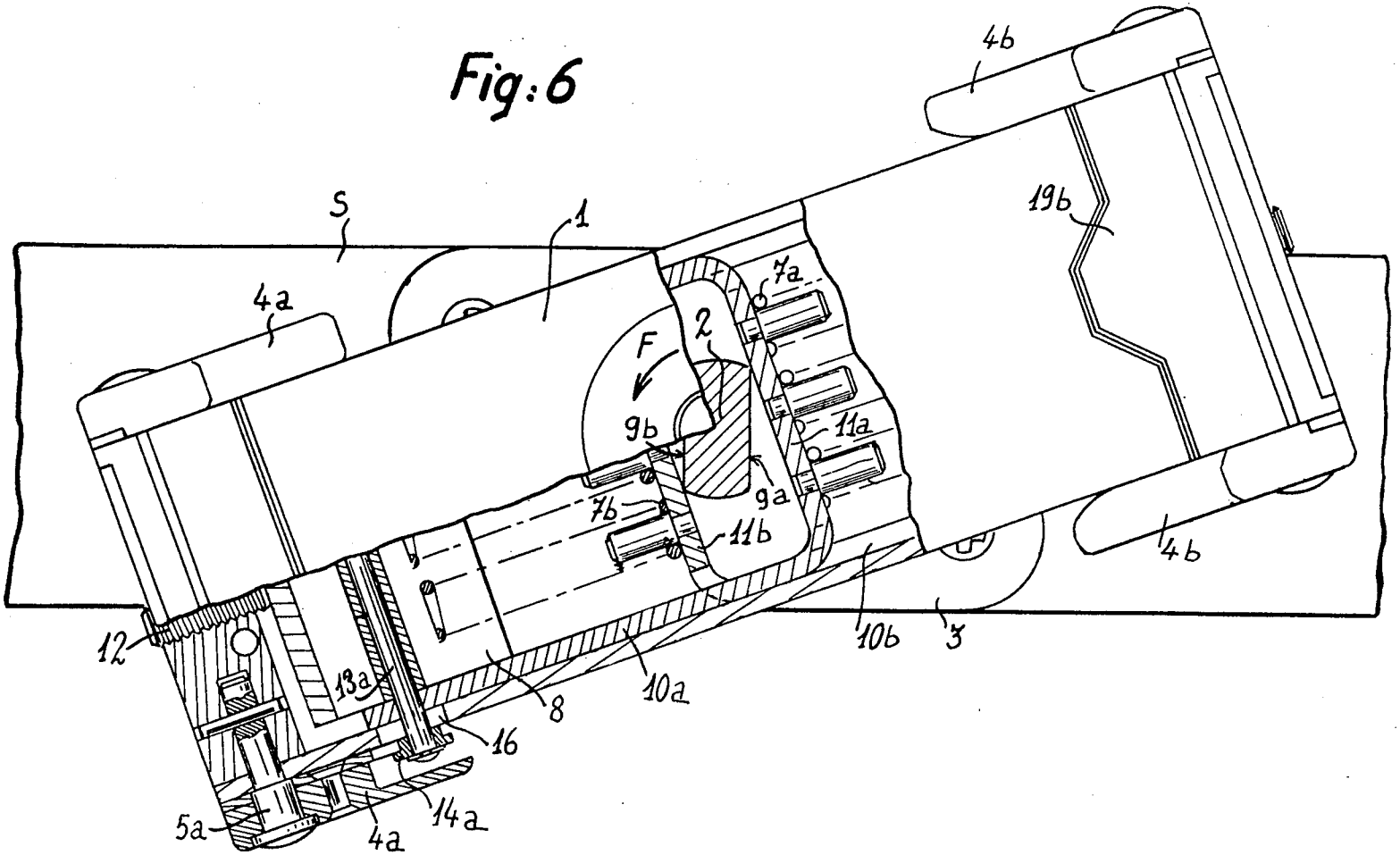
FIG. 6 is a plane view similar to FIG. 1 but showing the mode of operation of the present ski binding, in an intermediate angular position with respect to the ski.

2.—Torsion Stress (see FIG. 6)

In case the skier's leg were exposed to a torsion stress due, for example, to a fall, the case 1 would rotate about its pivot pin 2, for example in the direction of the arrow F, as illustrated in FIG. 6.

Consequently, in such occurrence the pistons consisting of the straps 10a and 10b are moved away from each other. However, since these straps cross each other, the corresponding pairs of rollers 14a and 14b are moved towards each other, i.e. towards the center. Thus, the pressure exerted by these rollers 14a, 14b on the ramp 17 of cams 15a and 15b is reduced so that the hooks 4a and 4b can pivot upwardly under the force of springs 20 provided for this purpose. However, it should be noted that these springs are relatively weak and not definitely necessary for the proper operation of the mechanism.

The amplitude of the hook movement depends on the amplitude of the movement of rollers 14a and 14b, and therefore on the angle of rotation of case 1. Thus, the boot is more or less released by the hooks according as the torsion applied to the boot is more or less pronounced. If a considerable torsion stress is exerted on the skier's leg and therefore on the boot, only a moderate lifting effort is sufficient for completing the opening movement of the hooks and releasing the boot completely.

Figure 7:
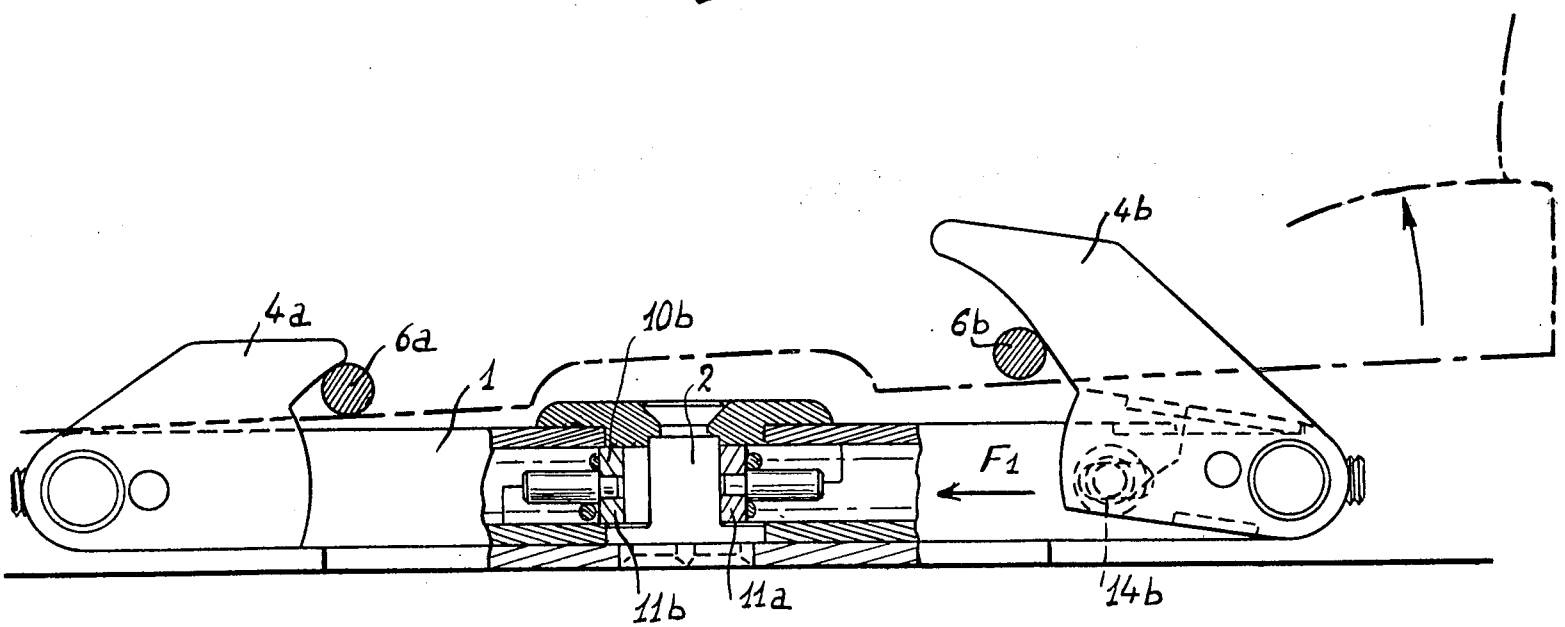
FIG. 7 is a view similar to FIG. 2 but showing the mode of operation of the ski binding in case of forward fall.

3.—Forward fall (see FIG. 7)

In this case, the heel of boot C will tend to lift off the case 1 so that the rear boot retaining members 6b tend to open the corresponding hooks 4b. As clearly shown in FIG. 7, the front hooks 4a are also lifted but to a minor extent.

Thus, the ramp 17 of cam 15b associated with the rear hooks will cause the relevant rollers 14b to move towards the centre, as shown by the arrow F1. Under these conditions, the corresponding strap 10b is pushed in the same direction, so that its median transverse rod 11b is moved away from the relevant cam 9b of pivot 2. The magnitude of the torque normally counteracting the rotation of case 1 is thus reduced in proportion.

Of course, at the same time the arm 11a of strap 10a is also moved slightly away from the corresponding cam 9a, but to a lesser extent, since the hook 4a is lifted to a relatively small degree.

However, the movement of strap 10b is sufficient for causing a substantial decrease in the torque tending to keep the case 1 in its normal position. Thus, in case of an incipient forward fall of the skier, a relatively small torsion stress may be sufficient for bringing about the rotation of case 1.

4.—Backward fall

In this case, the operation is the same as in the preceding case (Forward Fall) with the only difference that the front hooks 4a are lifted completely while the rear hooks 4b are only slightly lifted.

But, similarly, a substantial reduction in the magnitude of the torque tending to hold the case 1 against any rotational movement is obtained.

5.—Engagement of a ski boot (see FIGS. 3, 4, 8 and 9)

As already mentioned in the foregoing, the cams 15a and 15b comprise at their lower portion a bearing surface 18 having a part circular contour centered to the axis of the pivot pin carrying the associated hook. At the end of the hook lifting movement, the hook is in a condition of unstable equilibrium for the force exerted by the corresponding roller on the cam of this hook is transmitted through the pivot pin of this hook. Therefore, the hooks remain stably in their raised position after having been brought to this position either during a rotational release or as a consequence of a forward or backward fall.

In fact, in case of rotational release, all front and rear hooks are fully raised, after the boot has been released. In case of forward fall, the two rear hooks remain open. Finally, in case of backward fall, the front hooks are open.

Figure 8:
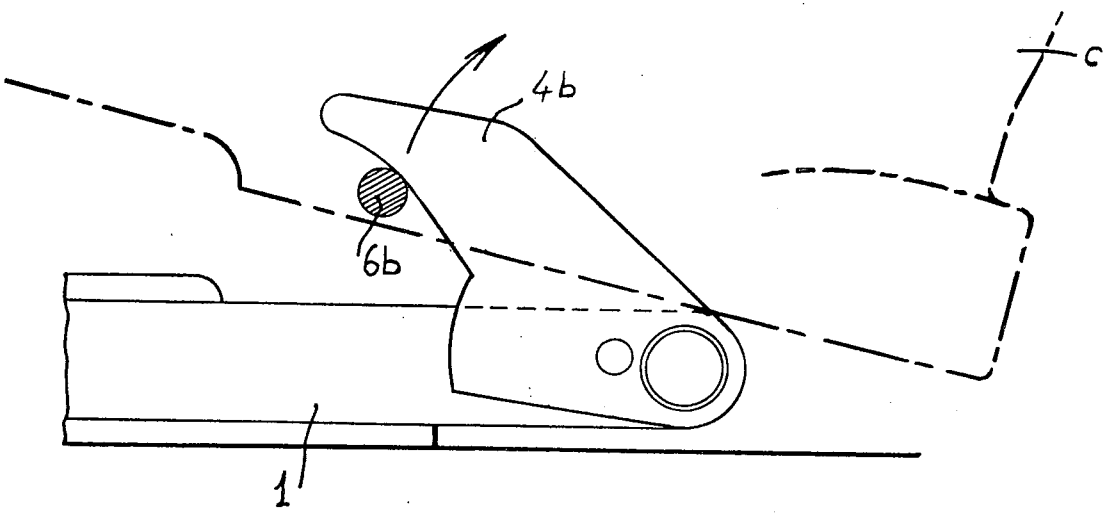
FIGS. 8 and 9 are diagrammatic side elevational views illustrating the mode of engagement of a ski boot with the boot retaining members of the binding.
Figure 9:
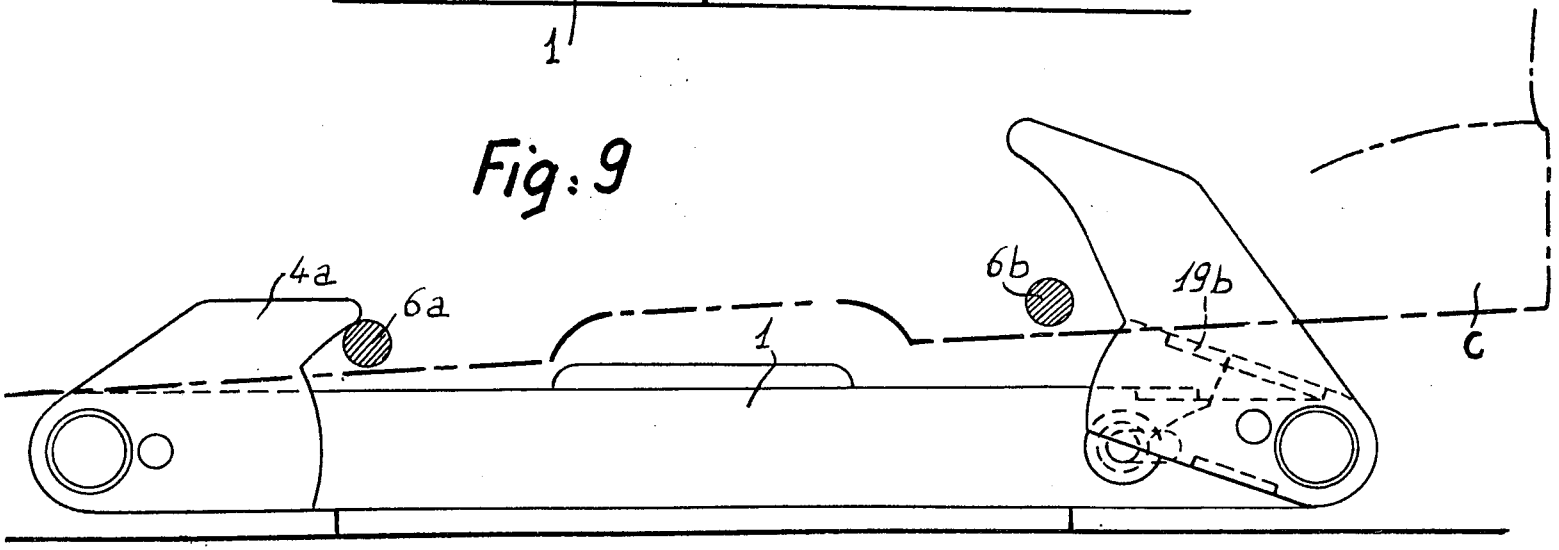

To re-engage the ski boot in the safety ski binding according to this invention, the rear hooks must be open. If not, they can be opened by engaging the rear retaining members 6b of the boot under the hooks, so as to move the latter to their upper position as shown in FIG. 8.

The full engagement of the ski boot is then obtained by thrusting these front retaining members 6a of the boot under the corresponding front hooks 4a and subsequently pressing the boot sole against the top of case 1. In fact, the sole is thus caused to exert a pressure on pedal 19b controlling the rear hooks, thus causing these hooks to pivot to their operative position. In this respect, it may be emphasized that it is particularly easy to re-engage a boot, without requiring any manual intervention from the skier.

The safety ski binding illustrated in FIGS. 10 to 14 of the drawings comprises, according to the preceding form of embodiment, a flat, elongated case 90 rotatably mounted about a fixed pivot pin 91 perpendicular to the top surface of the ski S and carried by a plate 93 fastened to the ski, for example by means of screws (not shown). The vertical axis XX' of pivot 91 is approximately coincident with the central point of case 90, and also and preferably with the location contemplated for the median transverse plane of the boot C.

The boot hooking device is adapted to co-act with retaining members embedded in the sole of ski boot C and consisting for example of a pair of transverse inserts 94 projecting from either side of the sole of boot C, on either side of the median transverse plane thereof, this plane containing preferably the vertical axis XX' as mentioned hereinabove.

The ski binding comprises on the one hand only a single movable member for hooking the boot C, which is displaceable between an operative or retaining position and an inoperative release position, and on the other hand a complementary, fixed boot hooking member rigid with the boot supporting case 90. In this modified form of embodiment, the movable boot hooking means comprise a pair of hooks 95 disposed on either side of the case 90 and adapted to pivot about trunnions 96 located on either side of the fixed pivot 91. The axis of said trunnions 96 is concurrent to the vertical axis XX' of pivot pin 91. Besides, according to a specific feature characterizing this form of embodiment, each hook 95 comprises an inclined ramp or cam face 97 adapted to cooperate with the corresponding end portion 98 of a spindle 99 extending transversely through a piston 101 slidably mounted in the front portion of the case. The end portions 98 project somewhat from the lateral walls of case 90 and are advantageously provided with rollers 102 engaging the cam-forming ramps 97.

Figure 10:
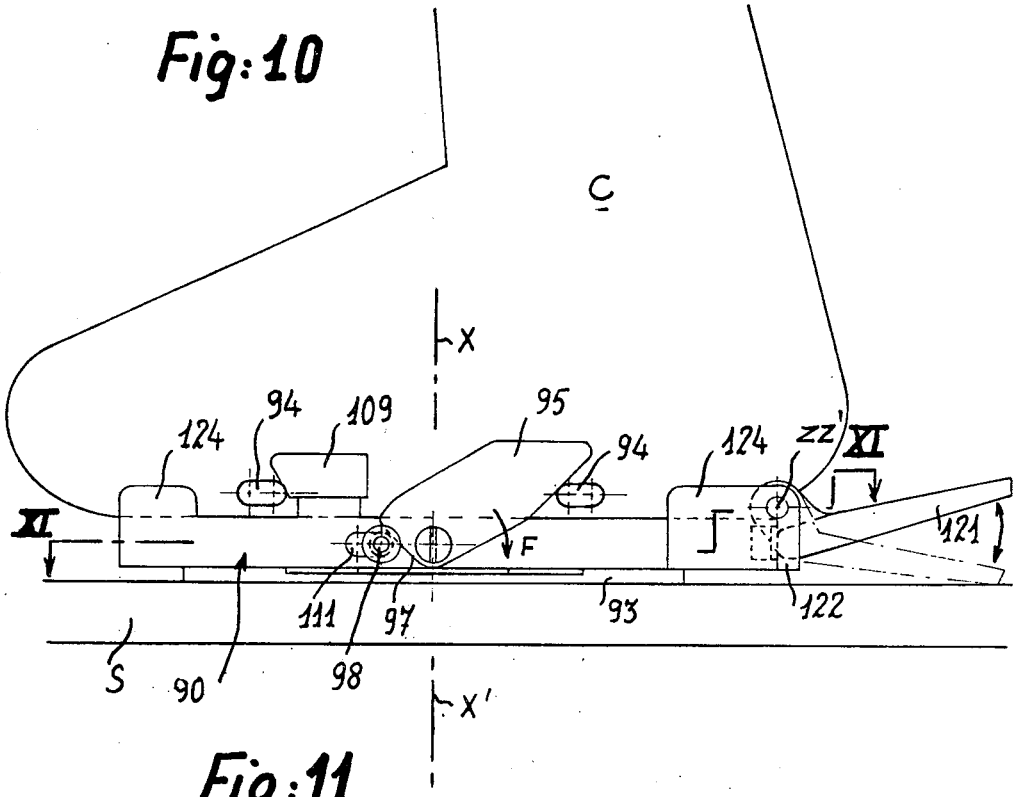
FIG. 10 is a side elevational view showing a second form of embodiment of the ski binding of this invention, mounted on a ski and engaged by a boot.
Figure 11:
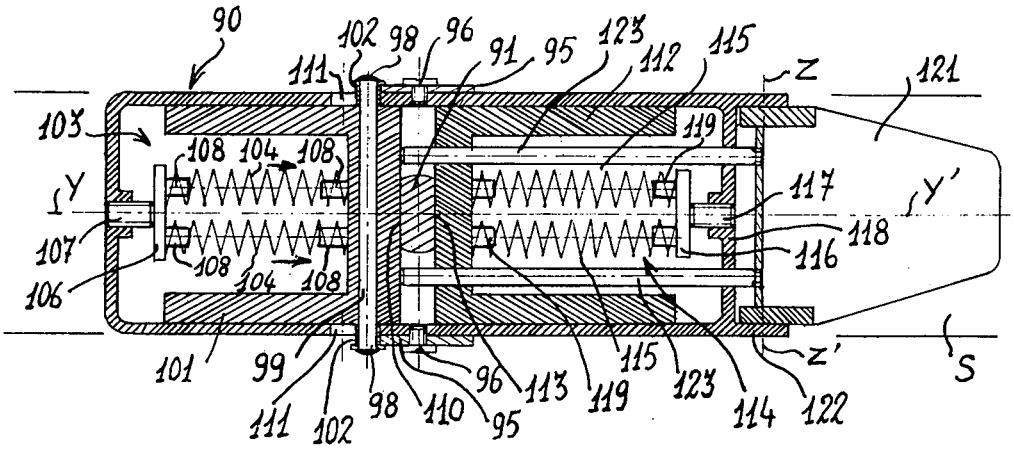
FIG. 11 is a section taken along the line XI—XI of FIG. 10.
Figure 12:
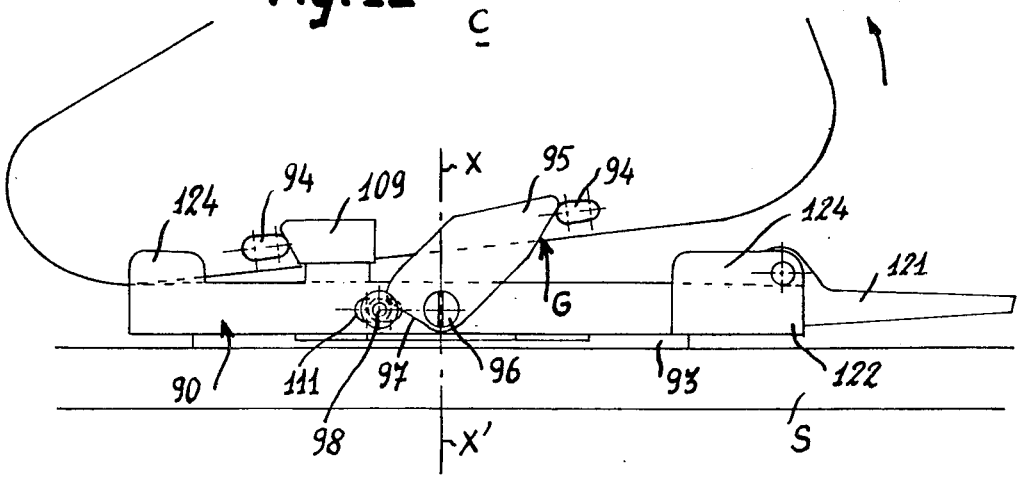
FIG. 12 is a longitudinal elevational view of the ski binding similar to FIG. 10 but with the toe end of the ski boot lifted.

A resilient system 103 constantly urges the piston 101 against the pivoting hooks 95 in order to keep the latter in their operative position as shown by the arrow F in FIG. 10. Simultaneously, the resilient system 103 also tends to keep the flat front face of piston 101 in engagement with a flat cam 110 formed on the fixed pivot 91 so as to hold the case 90 resiliently against any rotational movement in its normal position illustrated in FIG. 11.

In the example shown in FIGS. 10 to 14 the resilient system 103 comprises a pair of coil compression springs 104 disposed inside the U-shaped piston 101 and reacting against a member 106. This member 106 bears in turn against a screw 107 extending through a tapped hole formed in the adjacent transverse or end wall of case 1, so as to constitute a means for adjusting the hardness of the resilient system 103. The springs 104 of this system engage with their ends coaxial studs 108 for retaining the springs in proper alignment, at one end on piston 101 and at the other end on said member 106.

The fixed hooking means contemplated in combination with the movable means consisting of the pivoting hooks 95 comprises a pair of complementary hooks 109 rigid with the case 90 and each adapted to cooperate with an insert 94 embedded in, and projecting laterally from, the sole of boot C.

The end portions 98 of spindle 99 are adapted to move longitudinally in the elongated apertures 111 formed in the walls of case 90; thus, piston 101 can move within the limits of these elongated apertures, thus modifying the compression of the return springs 104. According to another feature of this invention the ski binding comprises a second piston 112 housed in the case 90 on the side opposed to the first piston 101 in relation to the fixed pivot 91; this second piston 112 is resiliently urged against a second flat cam face 113 parallel to the first cam 104 formed on pivot 91, so as to hold the case 90 against rotation due to the pressure exerted against cam 113. To this end, the piston 112, similar to piston 101, is responsive to another resilient system 114 reacting against the end of case 90 opposed to the end engaged by the first resilient system 103.

This other system 114 is similar to system 103 and comprises a pair of coil compression springs 115 reacting against an end member 116 of which the position along the longitudinal axis YY' of the ski binding is adjustable by means of a screw 117 engaging a tapped hole formed in the end or transverse wall 118 of case 90. These springs 115 are retained in their proper position by means of studs 119 similar to studs 108. Thus, the resilient system 114 constantly urges the front flat face of piston 112 against the flat cam 113 of pivot pin 91, i.e. holds the case 90 in its normal position.

According to another feature characterizing this invention, the ski binding is provided with a pivoted lever 121 fulcrumed to one end of case 90, i.e. the end adjacent the second piston 112. This lever 121 is thus pivoted to two end extensions 122 of case 90 about a transverse pivot axis ZZ'. When this lever 121 is actuated it causes the movement of the two parallel longitudinal rods 123 extending through the piston 112, as well as the cross wall 118, so as to urge the piston 101 away from the fixed pivot pin 91 and thus decrease the return torque in case of forward fall, when the lever 121 is pivoted. This arrangement is useful for the voluntary stripping of the ski boot by the skier himself who actuates the lever 121, for example by means of a ski pole. In fact, the pivotal movement of lever 121 releases the movable hooks 95 from the boot inserts 94. Finally, the ends of case 90 are provided with a pair of lateral lugs 124 at each end.

Figure 13:
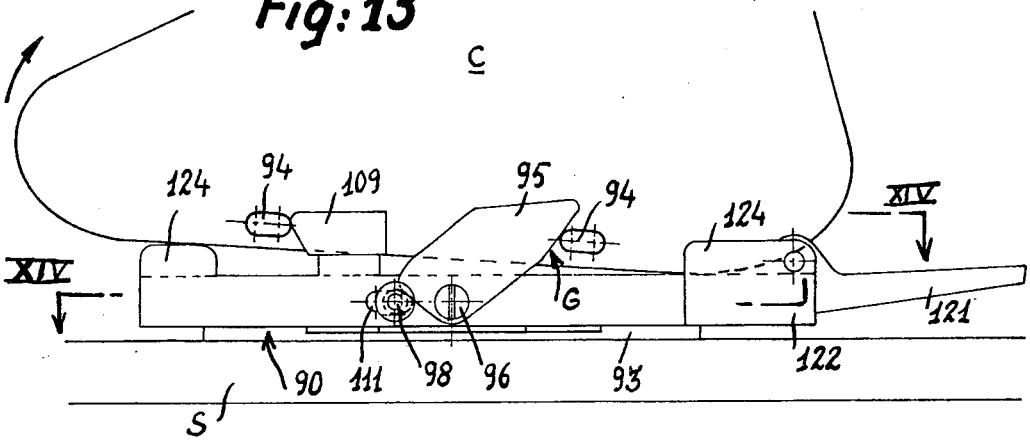
FIG. 13 is a view similar to FIG. 12 showing the condition of the ski binding when the boot is lifted at the heel.
Figure 14:
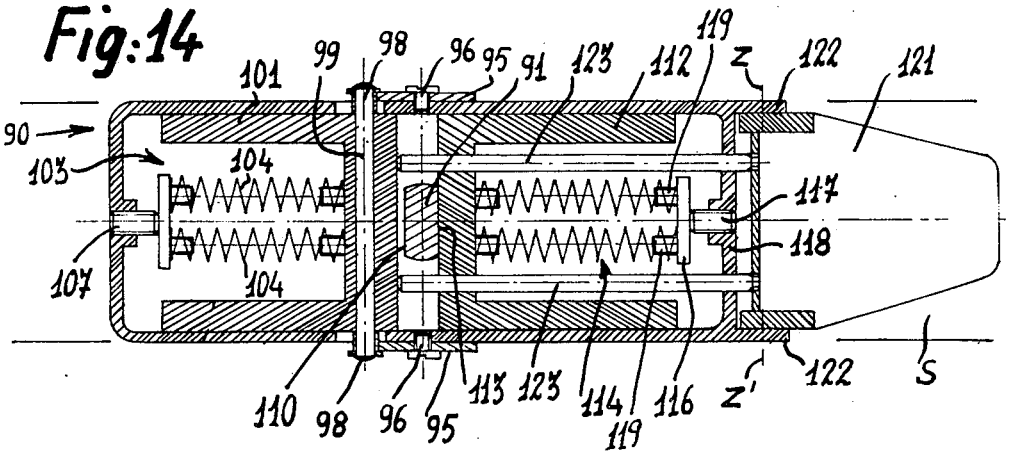
FIG. 14 is a longitudinal section taken along the line XIV—XIV of FIG. 13.
Figure 15:
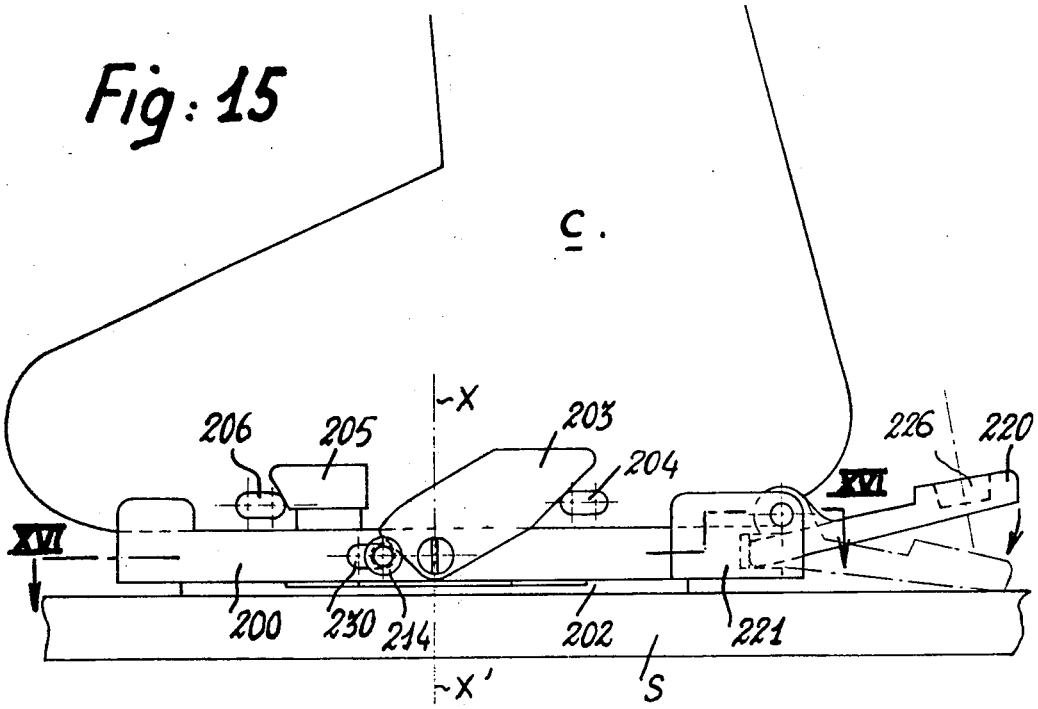
FIG. 15 is a side elevational view of a third form of embodiment of the ski binding according to the present invention, mounted on a ski and wherein a ski boot is engaged.
Figure 16:
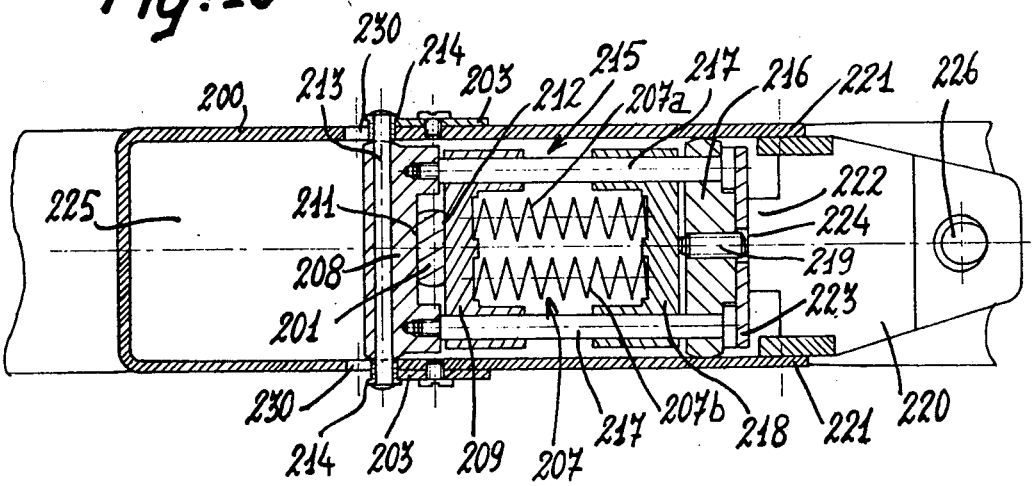
FIG. 16 is a section taken along the line XVI—XVI of FIG. 15.

The technical consequences and advantages of the above-described ski binding are as follows:

Let us assume that the skier is strongly leaning fowards (FIG. 12) or backwards (FIG. 13); it will be seen that the retaining inserts 94 embedded in the boot sole cause the hooks 95 to pivot upwards, as shown by the arrows G; correlatively, the rollers 102 roll on the relevant ramps 97 so that they recede into the elongated aperture 111, and the spindle 99 and piston 101 are moved away from the cam 104 of pivot pin 91, as illustrated in FIG. 14. It will also be seen that when the boot C is inclined to the rear, as shown in FIG. 13, the inserts 94 associated with the movable hooks 95 are less lifted above the ski than in the case of a forward inclination (FIG. 12), so that the piston 101 is nearer to pivot 91 than in the case of a backward inclination.

However, in the two cases contemplated hereinabove, the piston 101 does not exert any return torque on case 90. On the other hand, the resilient system 114 keeps holding the piston 112 against the flat cam 113 and consequently maintains a return rotational torque applied to the case 90, in the normal position thereof. Thus, the total return torque for centering the case 90 on the ski S is reduced but not eliminated, thus enabling the skier to keep a proper control of the ski concerned.

This ski binding is also attended by other technical advantages: the screws 107 and 117 permit of adjusting independently and very accurately the hardness of the device both in torsion and in case of vertical fall, the screw 117 permitting of adjusting only the torsion. In the form of embodiment shown in FIGS. 1 to 9 the hardness ratio of the torsion to forward or backward fall is given by construction, and cannot be modified according to particular requirements of the user.

The position of the pivoting hooks 95 in the central area of the case, the pivot axes of their trunnions 96 passing in fact through the centre of pivot 91, maintains in this area the efforts exerted against the ski binding. Thus, a lighter material can be used for manufacturing the case 90, for example a suitable plastic material; if metal is used for making the case 90, the latter may be much thinner in comparison with those of existing ski binding structures.

The provision of lugs 124 at the ends of case 90 permits of transmitting to the latter the torsion stresses exerted by the boot C while preventing these efforts from being applied to the movable hooks 95. Finally, as already mentioned hereinabove, the rear level 121 is convenient for voluntarily releasing the boot from the ski binding and the ski proper.

The third form of embodiment of the ski binding according to the present invention, as illustrated in FIGS. 15 to 19 of the drawings, comprises, as in the preceding forms of embodiment, a relatively flat, elongated case 200 adapted to act as a support to the ski boot C. This case 200 is adapted to rotate about a fixed axis perpendicular to the surface of the ski S and coincident with that of a fixed pivot pin 201 carried by a plate 203 firmly secured to the ski, for example by means of screws (not shown). The vertical axis XX' of pivot pin 201 is substantially coincident with the central point of case 200.

Figure 17:
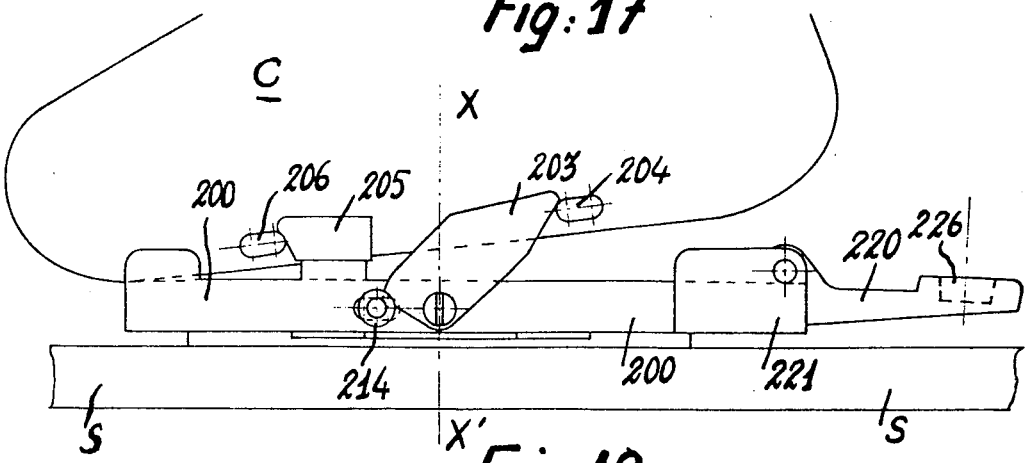
FIG. 17 is a longitudinal elevational view of the ski binding similar to FIG. 15 but with the ski boot lifted at its toe end.

The case 200 is provided with hook means 203 adapted to pivot on the case between an operative position (shown in FIG. 15) in which they cooperate with inserts 204 embedded in the boot sole in order to keep the boot on the case 200, and an inoperative position (shown in FIG. 17). These hooks 203 assume this second or inoperative position when an abnormally heavy stress is exerted on the skier's leg, the boot C being thus released from the case 200.

The case 200 also carries a pair of fixed hooks 205 adapted to cooperate with other inserts 206 embedded in the sole of boot C.

According to a specific feature characterizing this form of embodiment, the case 200 encloses a single resilient system 207 constantly urging a pair of pistons 208, 209, housed in case 200, against a pair of cams 211, 212 formed on opposite faces of the fixed pivot 201 about which the case 200 is rotatably mounted.

The piston 208 cooperates with the movable means for anchoring the boot C, i.e. the pivoting hooks 203.

The cam means 211, 212 consist of a pair of vertical flat faces, and in the example illustrated the resilient means 207 comprise a pair of coil compression springs 207*a*, 207*b*.

The first piston 208 has fitted therethrough a transverse spindle 213 carrying at its ends a pair of rollers 214 engaging the movable hooks 203, said ends being adapted to slide in elongated apertures 230 formed in the side walls of case 200. The piston 208 constitutes one of the small sides of a rectangular frame 215 comprising in addition to piston 208 a cross member 216 constituting the second small side and a pair of longitudinal tie-rods 217 interconnecting the piston 208 and cross member 216. These tie-rods 217 extend through longitudinal holes formed in the second piston 209 engaging the corresponding cam 212, and the first piston 208 engages the corresponding cam 211 under the pressure of the resilient system 207. Both tie-rods 217 can slide freely in the second piston 209, parallel to the longitudinal axis of the ski, when the springs 207*a*, 207*b* are compressed, and in this case the complete frame 215 moves longitudinally. The cross member 216 and the first piston 208 are guided longitudinally by the walls of case 200 when the frame 215 is moved within the case.

The resilient system 207 is interposed between the second piston 209 and a bearing member 218 through which the tie-rods 217 are adapted to slide, this member 218 being provided with means for adjusting its distance from the cross member 216. In the example illustrated these means consist of a screw 219 engaging a tapped hole formed through the cross member 216 so as to urge the bearing member 218 against the elastic pressure of the resilient system 207.

The positioning of the bearing member 218 by means of the adjustment screw 219 will set the hardness of the ski binding. On the other hand, the tie-rods 217 act as guide means to the second piston 209.

The ski binding further comprises a pivoting lever 220 pivoted to one end of case 200, namely the end adjacent the cross member 216. This lever 220 is fulcrumed to a pair of end extensions 221 of case 200 about a transverse axis, this lever 220 being provided with an integral intermediate lug 222 engaging a plate 223 secured to cross member 216. A central hole 224 is formed in said plate 223 to permit the insertion of a tool for adjusting the screw 219.

Figure 18:
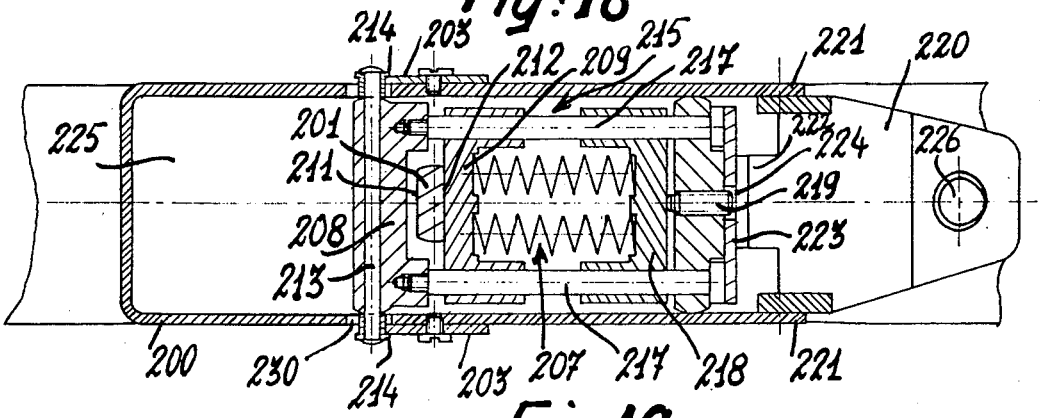
FIG. 18 is a view similar to FIG. 16 but showing the position of the frame of the ski binding when the boot is lifted at its toe end as shown diagrammatically in FIG. 17.
Figure 19:
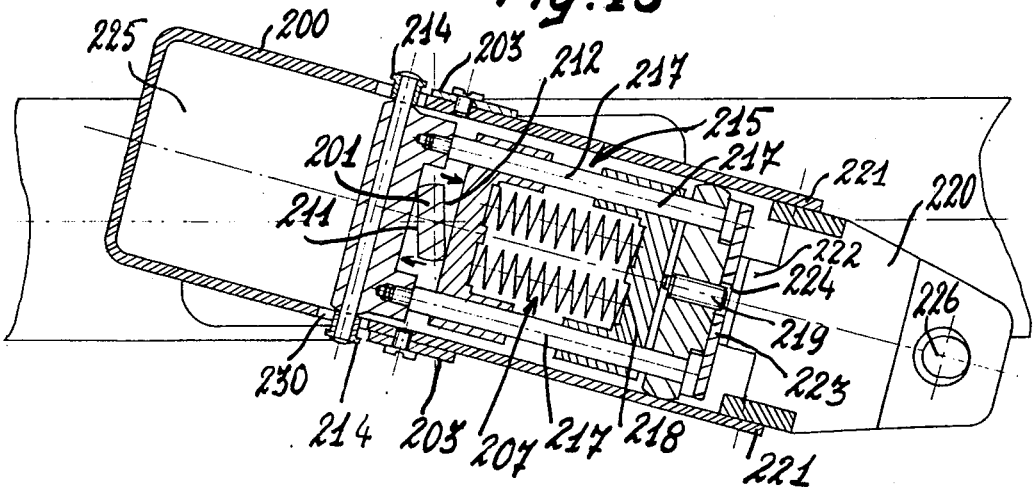
FIG. 19 is a section taken in the same plane as FIG. 16 but showing the position assumed by the component elements of the ski binding when a torsion stress is exerted on the skier's leg.

The lever 220 has formed therein a cavity 226 adapted to be engaged by the tip of a ski pole so that when a pressure is thus exerted on lever 220 the complete frame (208, 217, 216) is pushed to the left (as shown in FIG. 18). In this position, the first piston 208 is somewhat spaced from the fixed pivot 201, thus releasing the pivoting hooks 203.

Releasing the ski boot C voluntarily is also a very easy and simple operation, which can be performed either by using the ski pole or the other foot, or manually and even with the other ski.

In case of forward fall (FIGS. 17 and 18) the resultant pivotal movement of hooks 203 is attended by a forward movement of piston 208 which is thus separated from the associated cam 211 and the tie-rods 217 are caused to slide in the second piston 209 still engaging the flat cam 212. Therefore, the torsion torque retaining the case 200 on the ski S has descreased considerably but is not cancelled.

In case of pure torsion stress (position shown in FIG. 19) both pistons 208, 209 are moved away from the cam faces of pivot pin 201. Correlatively, the end rollers 214 of spindle 213 are moved away from the corresponding movable hooks 203 so that these hooks can open freely.

The device incorporated in the ski binding of FIGS. 15 to 19, notably in comparison with the embodiment of FIGS. 10 to 14, is remarkably simple. In fact, the number of component elements is reduced considerably, due to the elimination of one of the two resilient systems controlling the piston movements. As a result, a considerable space 225 is made available along nearly one-half of the length of case 200. This free volume can advantageously be used for housing an ancillary device, for instance the mechanism controlling a ski brake.

The ski binding structure shown in FIGS. 15 to 19 provides a complementary advantage in that the forces exerted on pistons 208 and 209 are no longer transmitted to the case 200 but are absorbed by the frame 208, 217, 216. Consequently, the case 200 can be made from a material having a lesser strength and therefore less expensive.

This invention should not be construed as being strictly limited by the specific forms of embodiment described and illustrated herein, since various modifications and changes may be brought thereto without departing from the basic principles of the invention as set forth in the appended claims. Thus, the cams of pivots 91, 201 are not necessarily made with the same shape and/or surface. More particularly, they may be curved, hollow or convex, and fit into correspondingly curved portions of the pistons.

The resilient systems cooperating with pistons 101 and 112 (in the form of embodiment shown in FIGS. 10 to 14) may differ from those illustrated and comprise if desired two springs on one side and three on the other, or even a single spring on each side.

The positions of the pivoting hooks 95 and fixed hooks 109 may be inverted, if desired, the hooks 95 being located in this case in the front portion of the ski binding and the hooks 109 in the rear portion thereof.

One may also associate the various hooking means of the ski binding with a sole having truncated end portions, of the type disclosed in the French patent appln. No. 77 36281 of Dec. 2, 1977 now U.S. application Ser. No. 962,185, filed Nov. 20, 1978. In this case, the inserts of the ski boot described hereinabove are replaced by the truncated end faces of the sole.

What is claimed as new is:

1. Safety ski binding for a ski boot having at least one external engageable member comprising a ski boot supporting member adapted to rotate about a pivot perpendicular to the ski surface and having the shape of a flat case, at least one boot hooking means mounted on said supporting member for movement between a normal operative position in which said hooking means cooperates with said engageable member so as to hold the latter against movement on said supporting member, and an inoperative position to which said hooking means is moved when an abnormal load is applied to the skier's leg, whereby said boot is released in relation to said supporting member resilient system mounted in said supporting member for urging on the one hand said supporting member to its normal position on the ski and on the other hand said hooking means to its operative position, and means forming a kinematic chain between said supporting member, said hooking means and said resilient system so acting that a movement of rotation of the supporting member which tends to move it away from its normal position is attended by a decrease in the force necessary to release said boot hooking means from its operative position, and that inversely a movement of said hooking means to its inoperative position is attended by a reduction in the force tending to hold the pivoted supporting member against rotation.

2. Ski binding as claimed in claim 1, wherein the pivot for the supporting member is substantially coincident with the middle point of the boot.

3. Ski binding according to claim 1, in which said pivot is provided with a first cam surface, said hooking means is provided with a second cam surface, and in which said resilient system includes at least one spring acting on the one hand upon said first cam surface to keep or urge said supporting member in or to its normal position relative to said ski surface and on the other hand upon said second cam surface, said cam surfaces being so arranged relative to one another and to said spring that rotation of said supporting member against the action of said spring results in a decrease in the pressure of said spring on said second cam surface and inversely the movement of said hook means toward its inoperative position results in a decrease in the pressure of said spring against said first cam surface.

4. Ski binding according to claim 3, in which said ski boot is provided with a pair of external engageable members, in which said hooking means comprises a pair of hooks pivotally mounted on either side of said supporting member in engageable relationship with the external members of the ski boot, in which the means forming said kinematic chain includes a strap frame comprising a flat end piece bearing against said first cam surface, a roller engaging said second cam surface, and a pair of side arms interconnecting said end piece and said roller, said end piece bearing against said cam surface on the side of the pivot opposite to the engagement of the roller with said second cam surface, and in which said spring acts upon said first cam surface through said flat end piece and upon said second cam surface through said roller.

5. Ski binding according to claim 3, in which said ski boot is provided with a pair of external engageable members disposed on either side of the central point of the ski boot, and in which said hooking means comprises pairs of longitudinally spaced hooks pivotally mounted on either side of said supporting member in engageable relationship to said external members, in which said pivot is provided with a pair of opposed cam surfaces, in which the means forming said kinematic chain includes a pair of flat overlapping strap frames each having end pieces respectively lying in engagement with said opposed cam surfaces, and in which said resilient system comprises two separate series of springs mounted in said supporting member, one on each side of said pivot and respectively urging said end members against said opposed cam surfaces.

6. Ski binding according to claim 4, wherein the profile of the said cam surface associated with the pivoting hook is such that the pivotal movement thereof towards its inoperative position is attended by a thrust exerted on the corresponding strap frame and consequently by a reduction in the pressure exerted by the end piece of said strap frame against said cam surface of the pivot.

7. Ski binding to claim 5, wherein the profile of the said cam surface associated with each pivoting hook is such that the pivotal movement thereof towards its inoperative position is attended by a thrust exerted on the corresponding strap frame and consequently by a reduction in the pressure exerted by the end piece of each strap frame against the corresponding cam surface of the support pivot.

8. Ski binding according to claim 4, wherein the cam surface associated with each pivoting hook is rigid therewith and includes a portion adapted to keep hook in its operative position after the pivotal movement of said hook towards said operative position.

9. Ski binding according to claim 5, wherein the cam surface associated with each pivoting hook is rigid therewith and includes a portion adapted to keep said hook in its operative position after the pivotal movement of said hook towards said operative position.

10. Ski binding according to claim 1, wherein said hooking means comprises a single movable means for hooking the ski boot, which is displaceable between an operative hooking position and an inoperative release position, and a complementary fixed boot hooking means rigid with the boot supporting case.

11. Ski binding according to claim 10 in combination with a second resilient system capable of providing a rotational return torque for constantly urging the supporting member to its normal position when the first resilient system ceases to deliver a rotational return torque, notably when the skier is leaning forwards or backwards.

12. Ski binding according to claim 10, in which said pivot is formed with a cam surface, in which the means forming said kinematic chain enclosed within said supporting member and urging said hooking means into its operative position, and in which said resilient means acts on the one hand against said cam surface and on the other hand against said piston to resiliently hold said supporting member against rotation from its normal position.

13. Ski binding according to claim 12, in which said hooking means comprises a pair of hooks pivotally mounted on said supporting member laterally of and on either side of said pivot, a spindle extending transversely through said piston and extending outwardly each side of said supporting means, and in which said hooks each include a ramp coacting with the outwardly extending ends of said spindle, whereby said resilient means acts upon said ramps on said hooks through the spindle in said piston.

14. Ski binding according to claim 12, in which said hooking means is attached to the central portion of said supporting member, the pivotal axis of said hooking means passing through the axis of the pivot.

15. Ski binding according to claim 11 in which the pivot is provided with a pair of opposed cam faces and in which the means forming said kinematic chain comprises a pair of pistons mounted within said supporting member, and in which the first resilient system urges one piston against one of said opposed cam faces and the said second resilient system urges the other system against the other of said opposed cam faces.

16. Ski binding according to claim 15, in combination with means for adjusting the hardness of the binding under torsion stress and/or during a vertical fall, said adjustment means comprising separate screws acting upon the resilient systems associated with each piston, respectively.

17. Ski binding according to claim 15, in combination with a lever pivotally mounted on one end of said supporting member, at least one rod slidably mounted in said other piston and abutting at one end against said one piston, and means operated by said lever on the other end of said rod for moving the latter to push said one piston away from its adjacent cam face, whereby said lever permits voluntary release of the ski boot from the binding.

18. Ski binding according to claim 1, in which the pivot is formed with a pair of opposed cam faces and in which the means forming said kinematic chain includes a pair of pistons housed in said supporting member, said resilient means normally urging each of said pistons against the respective opposed faces of said cam, in combination with means operated by one of said pistons normally urging said hooking means into engagement with the engageable member on the ski boot under the action of said resilient means, and means responsive to upward movement of the boot relative to the ski in the event of a forward fall of the skier for moving said one piston away from its adjacent cam surface while maintaining the other piston in engagement with its adjacent cam surface to maintain torque for retaining said supporting member in its position against torsion on the ski.

19. Ski binding according to claim 18, in which the one piston constitutes one of the small sides of a rectangular frame comprising, in addition to said piston, a cross member forming the second small side, and a pair of longitudinal connecting tie-rods, and in which said tie-rods extend through said other piston urged against said fixed pivot together with said one piston by said resilient system, the cross member and the one piston being guided longitudinally by the walls of said supporting member.

20. Ski binding according to claim 19, in combination with a bearing member slidably mounted on said rods, and in which said resilient system comprises a pair of compression springs each interposed between said other piston and said bearing member, whereby said frame is longitudinally movable within said supporting member upon movement of the one piston from its adjacent cam surface while said springs press upon said other piston in case of a forward fall of the skier, movement of said one piston tending to oppose the normal engagement of said hooking means with said engageable member.

21. Ski binding according to claim 20, in combination with means for adjusting the distance between said bearing member and the cross member of said frame, said means comprising a screw threadably engaging said cross member and extending therethrough against said bearing member against the thrust of said resilient system.

22. Ski binding according to claim 1, wherein said supporting member is provided with lateral lugs adapted to receive the torsion stresses exerted by the skier's boot when skiing.

* * * * *